US006935399B2

(12) United States Patent
Nien

(10) Patent No.: US 6,935,399 B2
(45) Date of Patent: Aug. 30, 2005

(54) CORD STOPPER FOR WINDOW BLIND ASSEMBLY

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/795,432

(22) Filed: Mar. 9, 2004

(65) Prior Publication Data

US 2004/0182525 A1 Sep. 23, 2004

(30) Foreign Application Priority Data

Mar. 18, 2003 (TW) ..... 92204497 U

(51) Int. Cl.[7] ..... E06B 9/30
(52) U.S. Cl. ..... 160/168.1 R; 160/178.1 R
(58) Field of Search ..... 160/178.1 R, 168.1 R, 160/178.2 R, 173 R, 177 R, 176.1 R; 24/129 R, 115 F

(56) References Cited

U.S. PATENT DOCUMENTS 4,635,698 A * 1/1987 Anderson ..... 160/178.2
4,967,824 A * 11/1990 Colson et al. ..... 160/178.1 R
5,068,949 A * 12/1991 Horace ..... 24/115 R
5,592,983 A * 1/1997 Sartini et al. ..... 160/178.1 R
5,671,508 A * 9/1997 Murai ..... 24/115 K
6,044,527 A * 4/2000 Ishida et al. ..... 24/129 R
6,453,974 B1 9/2002 Lai et al.
6,618,910 B1 * 9/2003 Pontaoe ..... 24/115 H
6,640,870 B2 * 11/2003 Osinga ..... 160/178.1 R
6,648,049 B2 * 11/2003 Bryant ..... 160/168.1 R

* cited by examiner

*Primary Examiner*—David Purol
(74) *Attorney, Agent, or Firm*—Bacon & Thomas PLLC

(57) ABSTRACT

A cord stopper for use in slidably and detachably connecting a lift cord of a window blind assembly includes a first cover shell having an insertion hole for insertion of the lift cord, a second cover shell openably closed to the first cover shell to form a receiving chamber therebetween, and a plurality of holding down members disposed in the receiving chamber for pressing the lift cord that is inserted through the insertion hole of the first cover shell to hold the cord stopper on the lift cord.

9 Claims, 6 Drawing Sheets

CORD STOPPER FOR WINDOW BLIND ASSEMBLY

BACKGROUND OF THE INVENTION

1. Field of the Invention

The present invention relates generally to a window blind assembly and more particularly, to a cord stopper which is detachably and slidably connectable to a lift cord of a window blind assembly.

2. Description of the Related Art

Window blind assemblies are intensively used to decorate windows and to shield windows from outside incident light. A window blind assembly constructed according to U.S. Pat. No. 6,453,974 is shown in FIG. 1, comprising a headrail 11, a bottom rail 12, a blind supporting system 13 joining the headrail 11 and the bottom rail 12 and mounted with a plurality of slats 14, two lift cords 15 each having a first portion 152 affixed to one end of the bottom rail 12 and upwardly penetrated through the slats 14 and the headrail 11 and a second portion 151 extended out of the headrail 11 through a lift cord lock 16 near one end of the headrail 11. The second portion 151 of each lift cord 15 is for pulling by the user to control the elevation of the bottom rail 12, i.e., changing the length of the second portion 151 of each lift cord 15 relatively control the extending (unfolding) status of the window blind assembly. A window blind assembly of this design is not safe in use. Because the first portion 152 of each lift cord 15 that passes through the slats 13 can easily be pulled by a child, and an accident may occur when a child playing with the first portion 152 of each lift cord 15 for fun and hang the first portion 152 of each lift cord 15 on the neck accidentally. Further, the lift cord lock 16 may fail, thereby causing the slats 14 and the bottom rail 12 to fall suddenly and to further hit a person below accidentally. In order to eliminate these problems, U.S. Pat. No. 6,453,974 uses two cord stoppers 17 to limit stretching of the first portion 152 of each lift cord 15. According to this design, each cord stopper comprises a locking guider having at least a guiding through slot provided thereon; each locking guider is slidably connected to the respective lift cord by tying an adjustable knot at the guiding through slot; the adjustable knot is constructed by tying the lift cord on the locking guider by forming a loop on the lift cord, passing the loop through the respective guiding through slot and penetrating a free end of the lift cord into the loop so as to form the adjustable knot tying around the locking guider, as shown in FIG. 2. This installation procedure is complicated and inconvenient.

Therefore, it is desirable to provide a window blind assembly having one or more cord stoppers that eliminate the aforesaid problem.

SUMMARY OF THE INVENTION

It is the primary objective of the present invention to provide a window blind assembly having at least one lift cord stopper, which prevents excessively stretching of the lift cords that pass through the slats.

It is another objective of the present invention to provide a window blind assembly having at least one lift cord stopper, which prevents falling of the bottom rail from the top position accidentally due to failure of the cord lock.

It is still another objective of the present invention to provide a window blind assembly having at least one lift cord stopper, which lift cord stopper is easy to install.

It is still another objective of the present invention to provide a window blind assembly having at least one lift cord stopper, which enables the user to conveniently adjust the position of each cord stopper.

It is still another objective of the present invention to provide a window blind assembly, which has the tied-up portion of each lift cord kept from sight, causing a sense of beauty.

To achieve these objectives of the present invention, the window blind assembly comprises a headrail, a bottom rail, a plurality of slats, a supporting unit connected to the headrail, the bottom rail and the slats for supporting the slats between the headrail and the bottom rail, a lift cord lock mounted on the headrail, a pair of lift cords each having an end affixed to the bottom rail, a first portion penetrated through the slats and extended through the headrail, and a second portion extended out of the headrail through the lift cord lock for operation to control elevation of the bottom rail, and at least one cord stopper including a first cover shell having an insertion hole, a second cover shell openably closed to the first cover shell to form a receiving chamber therebetween, and at least one holding down member disposed in the receiving chamber. A part of the second portion of the lift cord is positioned in the receiving chamber of the cord stopper by means of insertion of the second portion of the lift cord through the insertion hole of the cord stopper. The part of the second portion of the lift cord is pressed by the holding down member to hold the cord stopper on the second portion of the lift cord.

DETAILED DESCRIPTION OF THE INVENTION

Figure 3:
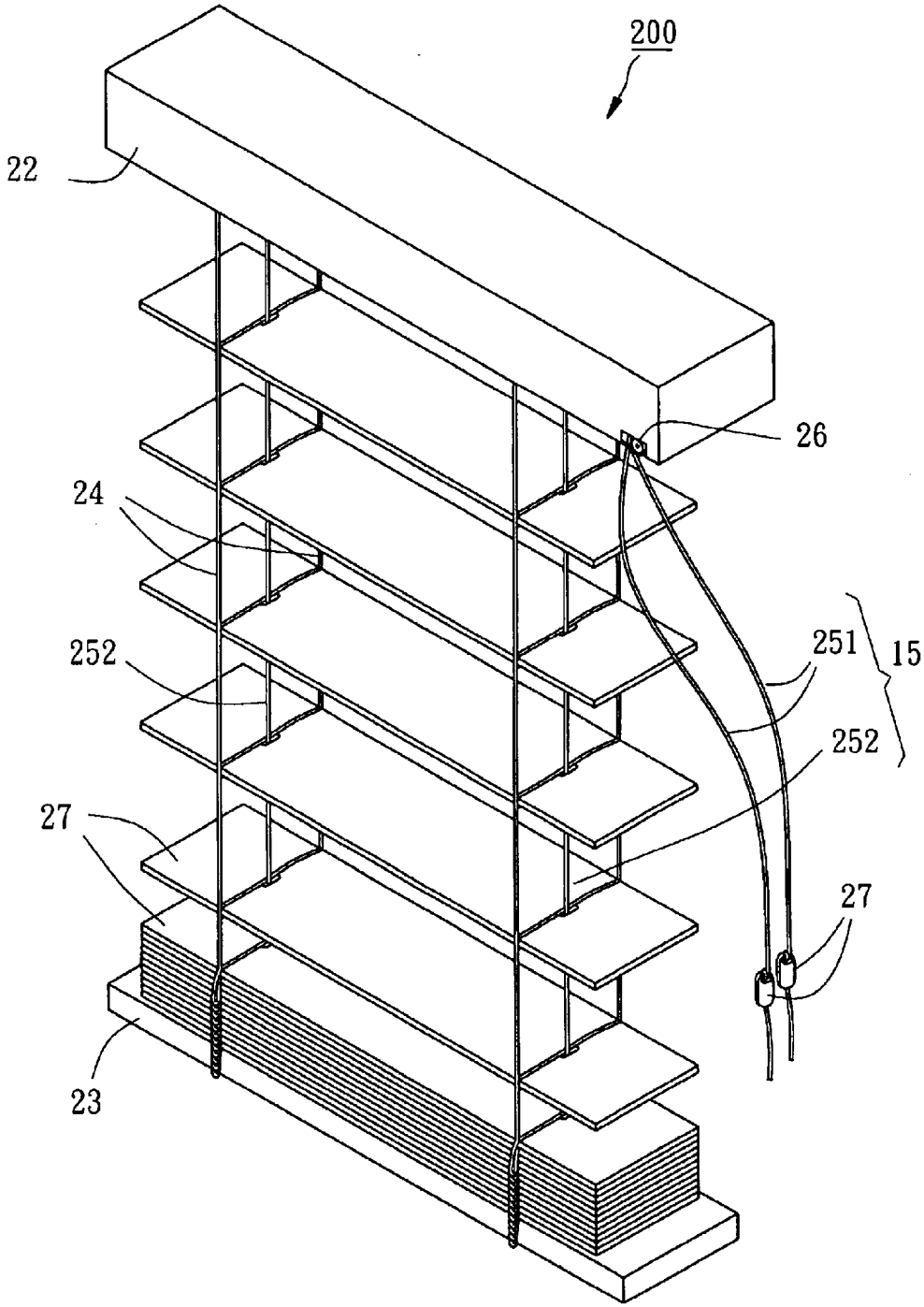
FIG. 3 is a perspective view of a window blind assembly constructed according to the present invention.

As shown in FIG. 3, a window blind assembly 200 is shown comprising a headrail 22, a bottom rail 23, a plurality of slats 21, a supporting unit including two ladder tapes 24 connected to the headrail 22, the bottom rail 23 and the slats 21 for spacedly supporting the slats 21 horizontally between the headrail 22 and the bottom rail 23, a pair of lift cords 25 each having an end (not shown) affixed to the bottom rail 23, a first portion 252 upwardly penetrated through the slats 21 and then transversely extended through the headrail 22, and a second portion 251 extended out of the headrail 22 through a lift cord lock 26 that is mounted on the headrail 22, and two cord stoppers 27 respectively fastened to the second portions 251 of the lift cords 25.

Figure 1:
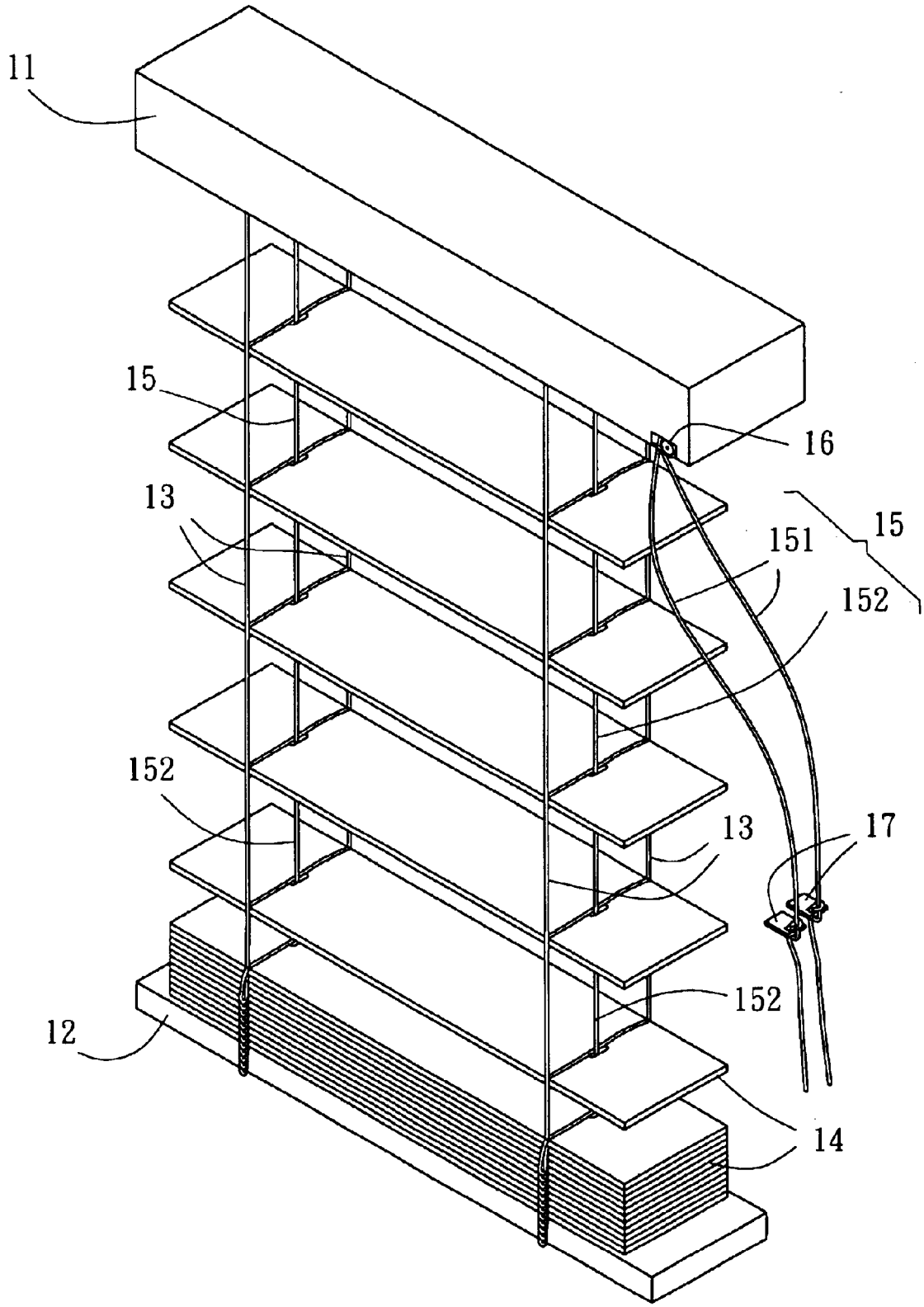
FIG. 1 PRIOR ART
FIG. 1 is a perspective view of a window blind assembly constructed according to U.S. Pat. No. 6,453,974.
Figure 4:
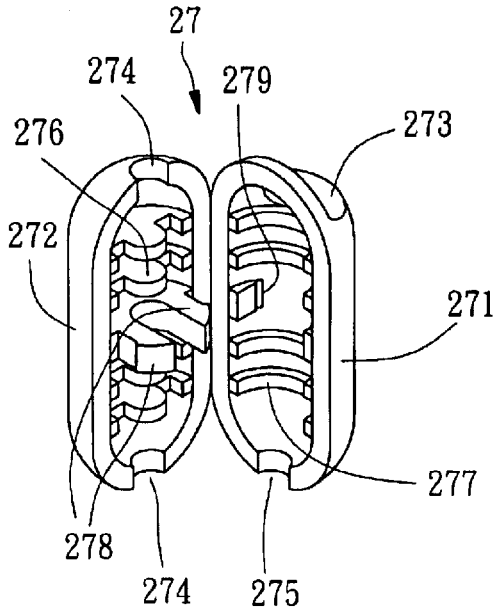
FIG. 4 illustrates the structure of the cord stopper used in the window blind assembly shown in FIG. 3.
Figure 2:
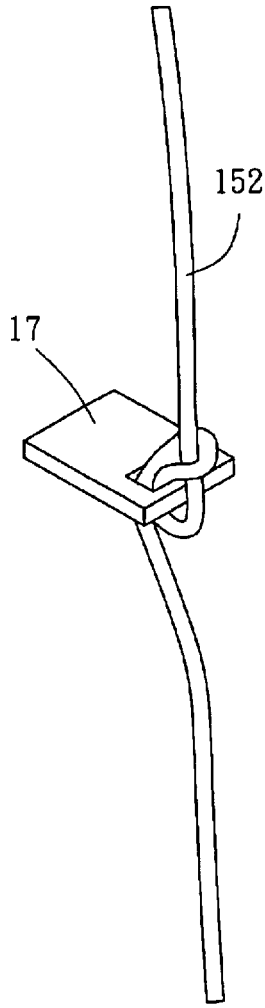
FIG. 2 is an enlarged view of a part of FIG. 1 showing the positioning of one cord stopper in the respective lift cord.
Figure 5:
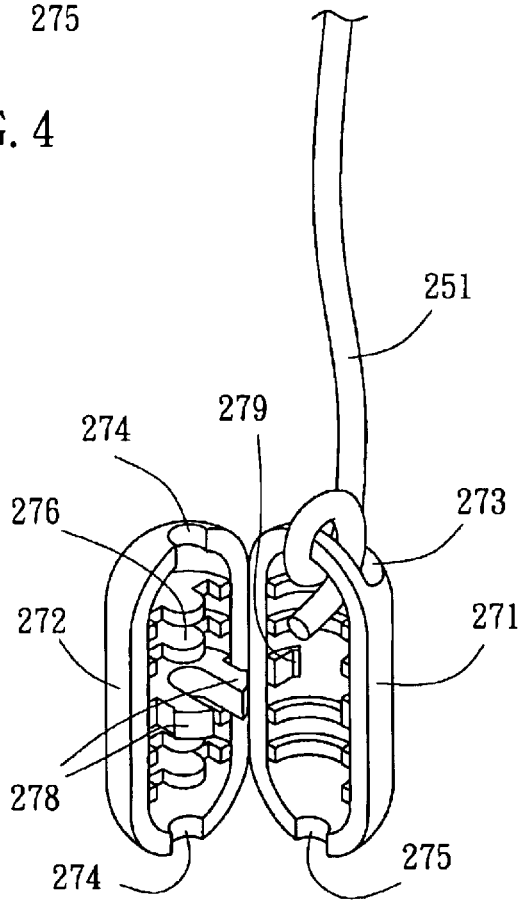
FIG. 5 is a schematic drawing showing one cord stopper fastened to one lift cord according to the present invention.
Figure 6:
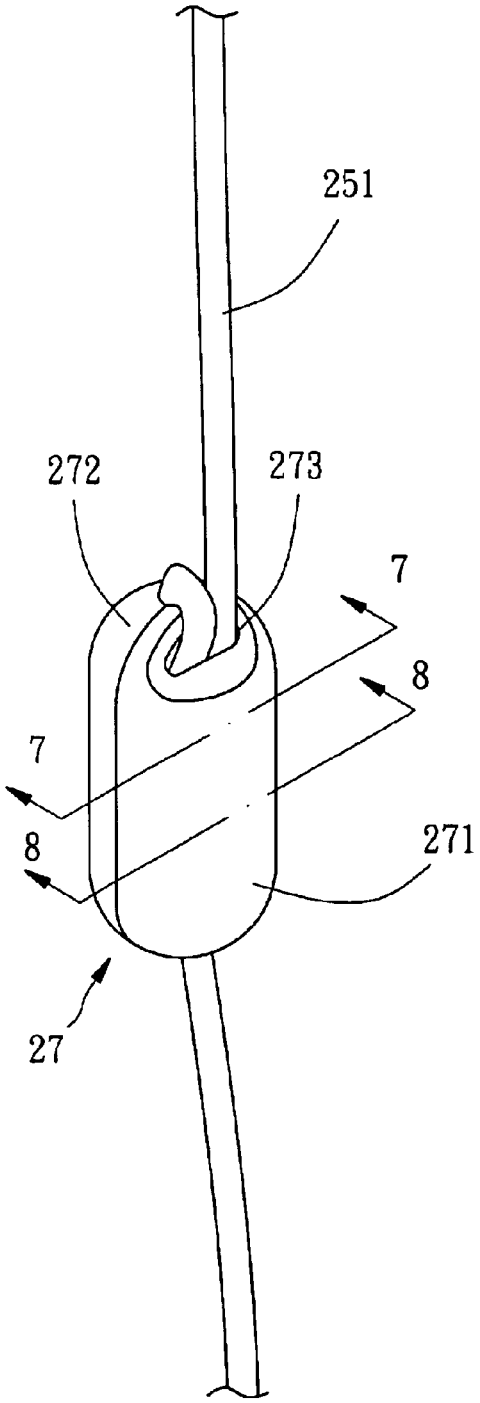
FIG. 6 is an assembly view of one lift cord and one cord stopper according to the present invention.

As shown in FIG. 4, the cord stopper 27 comprises two symmetrical hollow, elongated, oval-shape cover shells, namely, the first cover shell 271 and the second cover shell 272. The cover shells 271 and 272 have a respective lateral side integrally hinged to each other such that the cover shells 271 and 272 can be turned relative to each other between a close position as shown in FIG. 6 and an open position as shown in FIG. 5. In addition, the cover shells 271 and 272 have a respective recessed space faced to each other such that a receiving chamber is formed inside of the cord stopper when the two cover shells are turn to the close position. The first cover shell 271 comprises an insertion hole 273 in a first end, a wire notch 275 in a second end, a plurality of holding down members, for example, arched ribs 277 transversely disposed in the recessed space thereof, and two locating grooves 279 bilaterally disposed in the recessed space thereof. The second cover shell 272 comprises two wire notches 274 respectively formed in the two distal ends, a plurality of holding down members, for example, protrusion rods 276 respectively disposed in the recessed space thereof corresponding in location to the arched ribs 277 of the first cover shell 271, and two locating rods 278 bilaterally disposed in the recessed space thereof for engaging the locating grooves 279 of the first cover shell 271.

Figure 7:
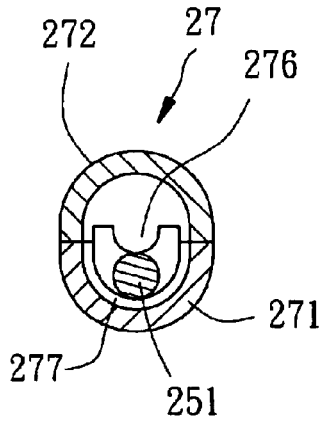
FIG. 7 is a sectional view taken along line 7—7 of FIG. 5.
Figure 8:
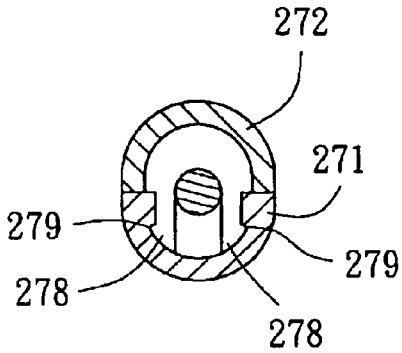
FIG. 8 is a sectional view taken along line 8—8 of FIG. 6.

The installation of the cord stoppers 27 to the lift cords 25 are outlined hereinafter with reference to FIGS. 5–8. For easy understanding of the present invention, the following description only explains the installation of one cord stopper 27 in one lift cord 25. At first, the first cover shell 271 and the second cover shell 272 are opened, and then a free end (not shown) of the second portion 251 of the lift cord is inserted downwardly through the insertion hole 273 into the inside of the first cover shell 271 and then turned upwards and then downwards and then inserted through the insertion hole 273 into the inside of the first cover shell 271 again to from a loop winding on the first cover shell 271, and then the free end of the second portion 231 is pulled downwardly out of the recessed space of the first cover shell 271 through the wire notch 275, and then the second cover shell 272 is covered on the first cover shell 271, keeping the knot thus made received inside the cord stopper 27 as shown in FIG. 6. When closed, the protrusion rods 276 of the second cover shell 272 are respectively pressed on the second portion 251 of the lift cord against the arched ribs 277 of the first cover shell 271, securing the cord stopper 27 to the second portion 251 of the lift cord in place as shown in FIG. 7. Further, when closed the cord stopper 27, the wire notches 274 and 275 accommodate a part of the second portion 251 of the lift cord, and the locating rods 278 of the second cover shell 272 are respectively engaged into the locating grooves 279 of the first cover shell 271, holding the cord stopper 27 in the closed status as shown in FIG. 8.

Figure 9:
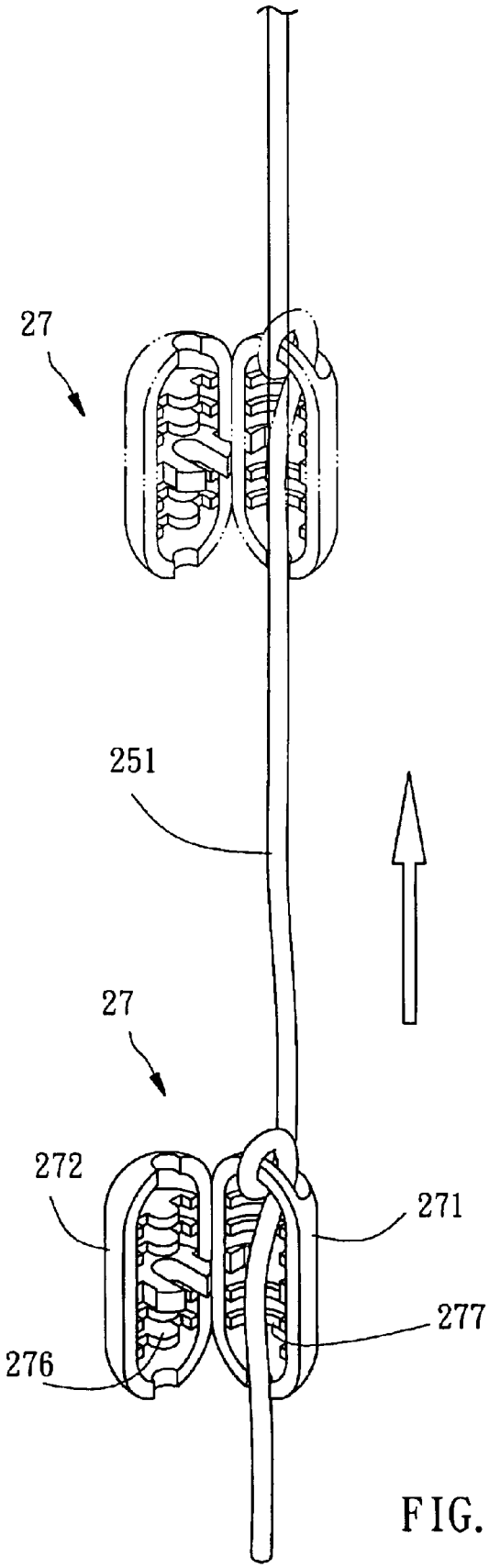
FIG. 9 is a schematic drawing showing position adjustment of the cord stopper on the lift accord according to the present invention.

Referring to FIG. 9, when adjusting the lifting range of the bottom rail 23 subject to one's desire or favorite, the position of the cord stoppers 27 should be relatively adjusted, preventing excessive stretching of the first portion 252 of each lift cord 25. The present invention enables the user to conveniently adjust the position of the cord stoppers 27 relative to the lift cords 25. The position adjustment of the cord stoppers 27 is easy. At first, open each cord stopper 27 by force (this can easily be achieved by an adult person). Because each lift cord 25 is fastened to the respective cord stopper 27 by a slip knot, the cord stopper 27 can easily be moved upwards or downwards on the respective lift cord 25 after opened the second cover shell 272 from the first cover shell 271. After adjustment, the first cover shell 271 and the second cover shell 272 are closed again.

Normally, the invention controls the sliding status of the lift cords 25 by means of the lift cord lock 26. If the lift cord lock 26 failed, the slats 21 and the bottom rail 23 forced to fall by their gravity weight. Falling of the bottom rail 23 drives the lift cords 25, causing the second portions 251 of the lift cords 25 to move toward the lift cord lock 26, and at the same time the cord stoppers 27 are respectively moved with the second portions 251 of the lift cords 25 and then stopped at the lift cord lock 26 where the cord stoppers 27 lock up the downward falling movement of the bottom rail 23.

Figure 10:
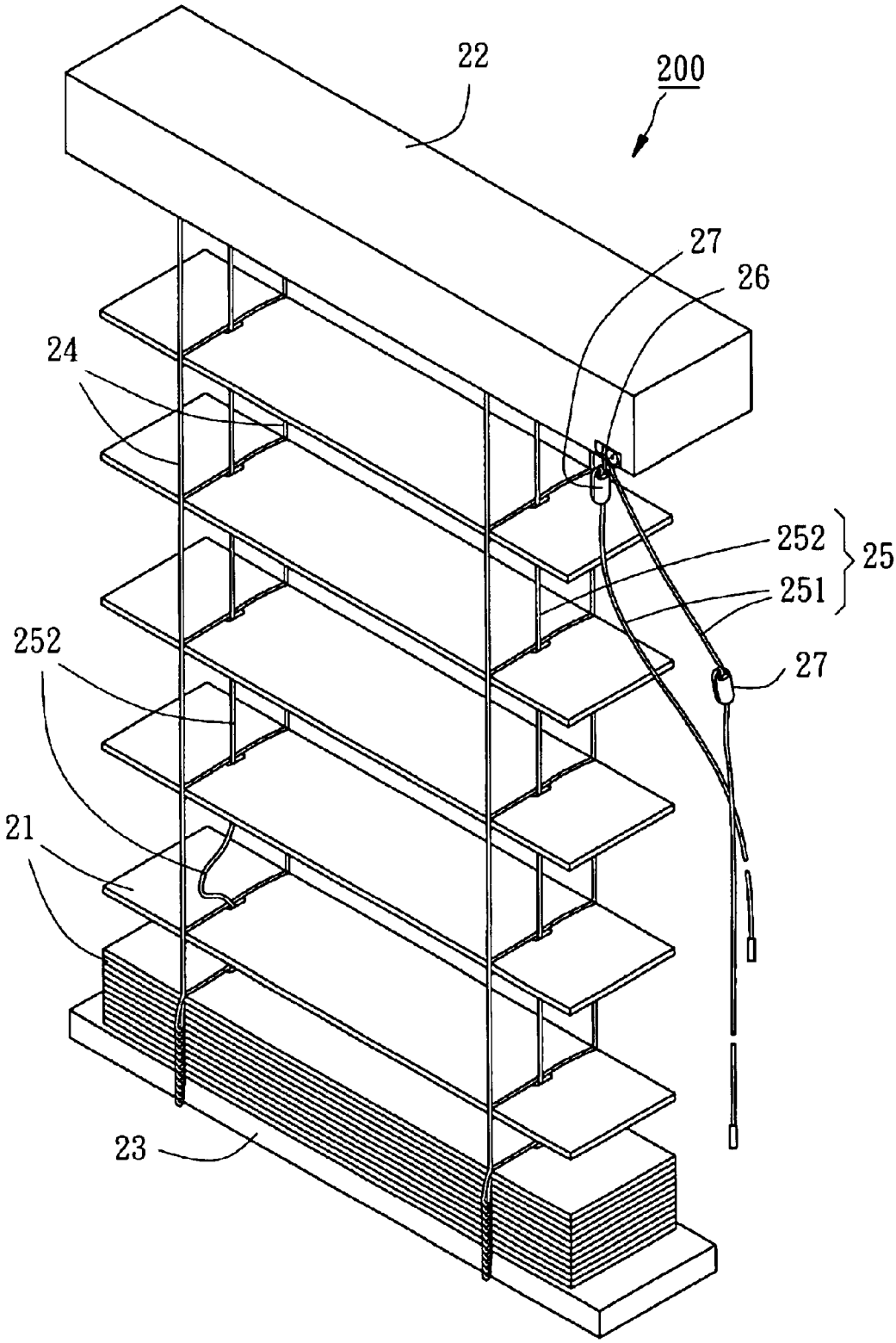
FIG. 10 is a schematic drawing showing one of the cord stoppers stopped at the headrail according to the present invention.

As shown in FIG. 10, if a child pulled the first portion 252 of one lift cord 25 between two adjacent slats 21 for fin, the respective cord stopper 27 will be moved upwards and stopped at the lift cord lock 26 in case the lift cord lock 26 failed at this time, preventing excessive stretching of the first portion 252.

As indicated above, the invention has numerous advantages as outlined hereinafter.

1. By means of the cord stoppers 27, the invention limits sliding of the lift cords 25 even if the lift cord lock 26 fails.

2. By means of inserting the second portion 251 through the insertion hole 273 of the first cover shell 271, the cord stopper 27 is easily fastened to the respective lift cord 25.

3. By means of the cord stoppers 27, the moving distance of the bottom rail or the stretching distance of the lift cords is well controlled, preventing an accident.

4. The protrusion rods 276 of the second cover shell 272 are respectively pressed on the second portion 251 of the lift cord against the arched ribs 277 of the first cover shell 271, securing the cord stopper 27 to the second portion 251 of the lift cord in place.

5. After installation, the user can adjust the elevational position of the cord stoppers 27 relative to the second portions 251 of the lift cords 25 simply by opening each cord stopper 27 and then moving each cord stopper 27 relative to the respective lift cord 25 to the desired elevation and then closing each cord stopper 27 again.

6. The cord stoppers can be used in a conventional window blind assembly without making any structural change of the window blind assembly.

7. Because the knot of each lift cord 25 is received inside the respective cord stopper 27, the sense of beauty of the window blind assembly is maintained intact.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A window blind assembly comprising:

a headrail;

a bottom rail;

a plurality of slats;

a supporting unit connected to said headrail, said bottom and said slats for supporting said slats between said headrail and said bottom rail;

a lift cord lock mounted on said headrail;

a pair of lift cords each having an end affixed to said bottom rail, a first portion penetrated through said slats and extended through said head rail, and a second portion extended out of said headrail through said lift cord lock for operation to control elevation of said bottom rail; and at least one cord stopper including a first cover shell having an insertion hole formed in a first end thereof and a wire notch formed in a second end thereof, a second cover shell openably closed to said first cover shell to form a receiving chamber therebetween, the second cover shell having a wire notch formed in each of a first end and a second end thereof, and at least one holding down member disposed in the receiving chamber;

wherein a part of the second portion of said lift cord is positioned in the receiving chamber of the cord stopper by forming a loop winding of the second portion of said lift cord through and around the insertion hole of said cord stopper, engaged within the wire notch in the first end of the second cover shell, pressed by the holding down member and engaged within the wire notches in the second ends of the first and second cover shells to hold the cord stopper on the second portion of said lift cord.

2. The window blind assembly as claimed in claim 1, wherein said first cover shell and said second cover shell each have a lateral side respectively integrally hinged to each other so that said first cover shell and said second cover shell are turnable relative to each other between a close position and an open position.

3. The window blind assembly as claimed in claim 1, wherein the cord stopper comprises a plurality of said holding down members which include ribs provided at said first cover shell and protrusion rods provided at said second cover shell corresponding in location to the ribs of said first cover shell; wherein the second portion of said lift cord is pressed between the ribs of said first cover shell and the protrusion rods of said second cover shell.

4. The window blind assembly as claimed in claim 1, wherein said first cover shell has a locating groove, and said second cover shell has a locating rod for engaging the locating groove of said first cover shell when said first cover shell and said second cover shell are closed.

5. The window blind assembly as claimed in claim 1, wherein said supporting unit comprises at least two ladder tapes.

6. A cord stopper for slidably and detachably connecting a lift cord of a window blind assembly, said cord stopper comprising:

a first cover shell having an insertion hole formed in a first end thereof and a wire notch formed in a second end thereof, the insertion hole for inserting the lift cord to form a loop winding around the insertion hole;

a second cover shell openably closed to said first cover shell to form a receiving chamber therebetween, the second cover shell having a wire notch formed in each of a first end and a second end thereof, and at least one holding down member disposed in the receiving chamber for pressing the lift cord that is inserted through the insertion hole of said first cover shell to hold the cord stopper on the lift cord.

7. The cord stopper as claimed in claim 6 comprising a plurality of said holding down members which include ribs provided at said first cover shell and protrusion rods provided at least second cover shell corresponding in location to the ribs of said first cover shell; wherein the lift cord is pressed between the ribs of said first cover shell and the protrusion rods of said second cover shell.

8. The cord stopper as claimed in claim 6, wherein said first cover shell has a locating groove, and said second cover shell has a locating rod for engaging the locating groove of said first cover shell when said first cover shell and said second cover shell are closed.

9. The cord stopper as claimed in claim 6, wherein said first cover shell and said second cover shell each have a lateral side respectively integrally hinged to each other so that said first cover shell and said second cover shell are turnable relate to each other between a close position and an open position.

* * * * *